US007381084B1

(12) United States Patent
Horn et al.

(10) Patent No.: US 7,381,084 B1
(45) Date of Patent: Jun. 3, 2008

(54) CONNECTOR POSITION ASSURANCE ARRANGEMENT

(75) Inventors: Jacob K. Horn, Ypsilanti, MI (US); William R. Tabor, Livonia, MI (US)

(73) Assignee: Chrysler LLC, Auburn Hills, MI (US)

( * ) Notice: Subject to any disclaimer, the term of this patent is extended or adjusted under 35 U.S.C. 154(b) by 0 days.

(21) Appl. No.: 11/736,121

(22) Filed: Apr. 17, 2007

(51) Int. Cl.
*H01R 3/00* (2006.01)

(52) U.S. Cl. ..... 439/489; 439/350

(58) Field of Classification Search ..... 439/489, 439/350–358

See application file for complete search history.

(56) References Cited

U.S. PATENT DOCUMENTS 6,881,103 B2 4/2005 Dawidziuk

2003/0003792 A1* 1/2003 Endo ..... 439/352

* cited by examiner

*Primary Examiner*—Ross N Gushi
(74) *Attorney, Agent, or Firm*—Ralph E. Smith

(57) ABSTRACT

An electrical connector assembly adapted to mate with a device. The connector assembly includes a housing with a primary latch assembly that engages the device, and a connection position assurance (CPA) component that is telescopically engageable over an outer surface of the housing. The connection position assurance component includes a secondary latch assembly that engages the primary latch assembly. The primary latch assembly includes a latching portion that may be actuated by a lever, and the secondary latch assembly prevents the lever from actuating the latching portion when the electrical connector assembly is mounted to the device.

13 Claims, 3 Drawing Sheets

CONNECTOR POSITION ASSURANCE ARRANGEMENT

FIELD OF THE INVENTION

The present invention relates to an electrical connection assembly that assures complete connection between an electrical connector assembly and an electrical device.

BACKGROUND OF THE INVENTION

A wide variety of electrical connectors exist for various applications. These electrical connectors may include what is known as a connection position assurance (CPA) component. The CPA component ensures that the connector assembly is fully mated with an electrical device. The CPA component, however, is generally located on a single side of the connector housing. When the CPA component is located on a single side of the connector housing, and the connector assembly is to be connected with a device in a hard to reach space, it may be difficult to engage the CPA component. For example, if the devices is disposed in a tightly confined space between various additional components, it may be difficult to reach the CPA component to engage it. Furthermore, if the device is oriented in a way such that the CPA component of the connector assembly is on the side of the connector housing that is disposed away from the installer, the installer may have to orient himself in a manner that enables him to engage the CPA component. Each of these situations results in difficulty in installing the connector assembly, and increased installation time.

SUMMARY OF THE INVENTION

The present disclosure provides an electrical connector assembly with a CPA component adapted to operate in tight fitting applications. The connector assembly includes a housing which has a primary latch assembly that engages the device, and a connection position assurance (CPA) component that is telescopically engageable over an outer surface of the housing. The connection position assurance component includes a secondary latch assembly that engages the primary latch assembly. The primary latch assembly includes a latching portion that may be actuated by a lever, and the secondary latch assembly prevents the lever from actuating the latching portion when the electrical connector assembly is mated to the device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description is merely exemplary in nature and is in no way intended to limit the invention, its application, or uses.

Figure 1:
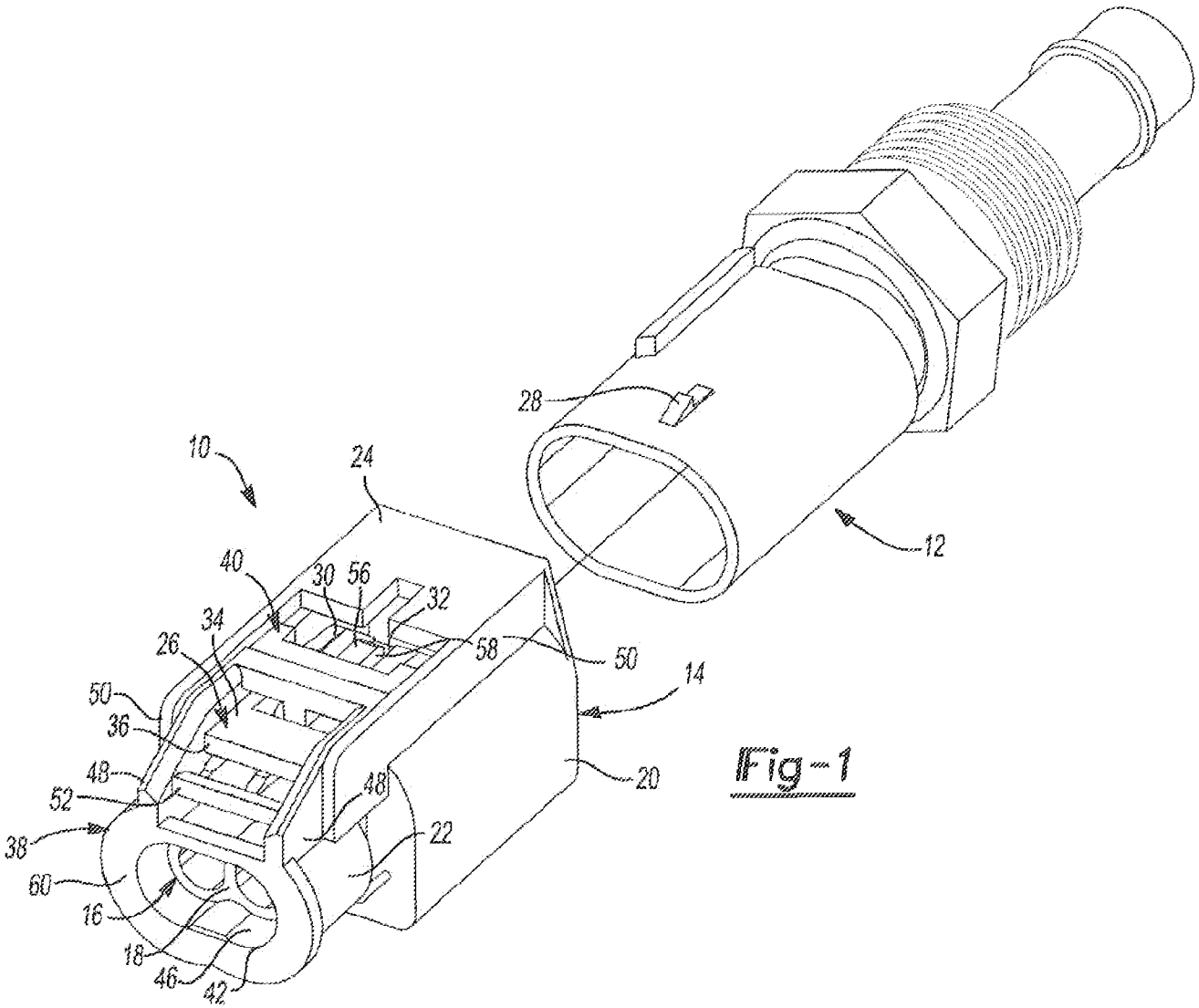
FIG. 1 is a perspective view of a connector assembly according to the present teachings in a unlatched state.
Figure 2:
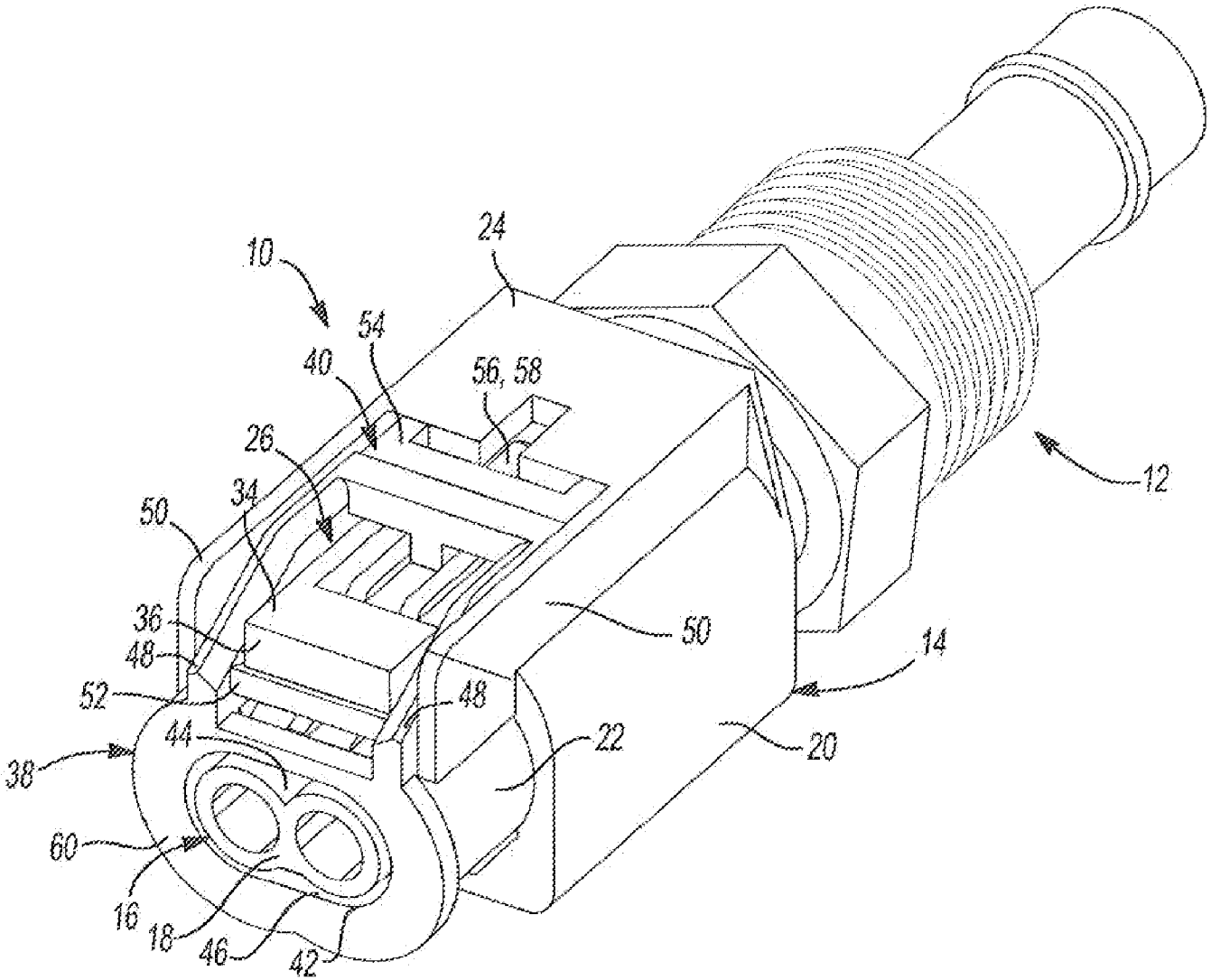
FIG. 2 is a perspective view of the connection assembly illustrated in FIG. 1 in a latched state.

Referring to FIGS. 1 and 2, an electrical connector assembly 10 is disposed relative to a device 12 to which the electrical connector assembly 10 mates. The electrical connector assembly 10 includes a mating end 14 that mates with the device 12 and a terminal loading end 16 that includes a pair of electrical wire conduits 18. The electrical wire conduits 18 provide a pathway for wires and terminals to pass through the electrical connector assembly 10 and electrically connect with the device 12. The connected assembly provides a pathway for electrical activation of the device; such as, for example, a sensor.

As best shown in FIGS. 1-5, the connector assembly 10 generally includes a housing 20 and a connector position assurance (CPA) component 22 that ensures that the connector assembly 10 completely mates with device 12. Housing 20 is generally a hollow monolithic, plastic structure that includes wire conduits 18 that provide electrical communication with a device via terminals (not shown) housing by housing 20, which in turn mechanically engage with electrodes (not shown) located within device 12.

On an upper surface 24 of housing 20 is a first or primary latch assembly 26 that secures connector assembly 10 to the device 12. Primary latch assembly 26 couples to a protrusion or nib 28 formed on device 10. Primary latch assembly 26 may be an actuatable assembly that enables connector assembly 10 to engage and disengage from device 12. In this regard, at a distal end 30 of latch assembly 26 may be a latching portion 32 in the form of an opening or hook that may latch or catch protrusion 28. To disengage opening or hook 32 from protrusion 28, latch assembly 26 may be provided with a lever 34 at a proximate end 36 of latch assembly 26. By depressing lever 34, opening or hook 32 may be lifted off protrusion 28 to disengage connector assembly 10 from device 12.

Although the above-described connection mechanism between connector assembly 10 and device 12 may ensure a reliable electrical connection, it should be understood that if connector assembly 10 is used in an automotive application, connector assembly 10 may not always be completely mated to device 12 due to human error experienced during assembly of the vehicle, or during maintenance of various devices and systems located adjacent the mated connector assembly 10 and device 12. To further reliably attach connector assembly 10 to device 12, therefore, connector assembly 10 of the present teachings may be provided with CPA component 22.

Figure 3:
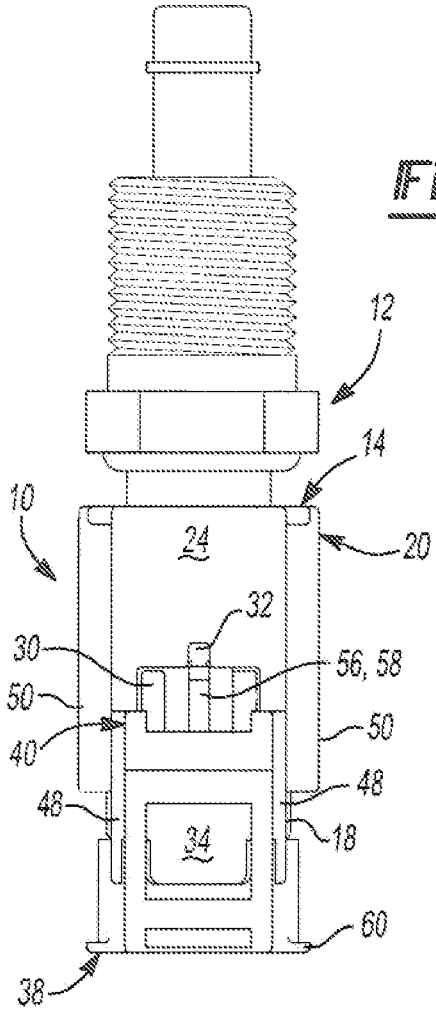
FIG. 3 is a top-perspective view of the connector assembly illustrated in FIG. 1.
Figure 4:
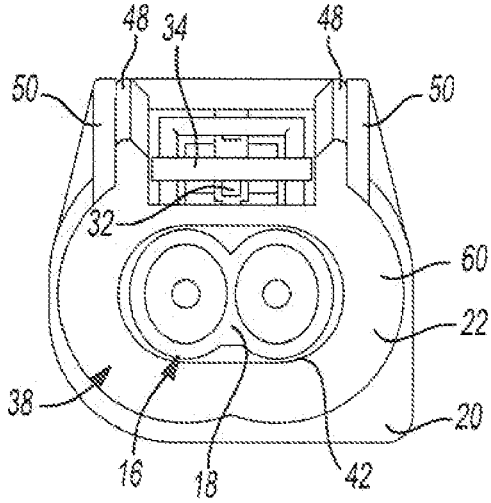
FIG. 4 is a rear perspective view of the connector assembly illustrated in FIG. 1.
Figure 5:
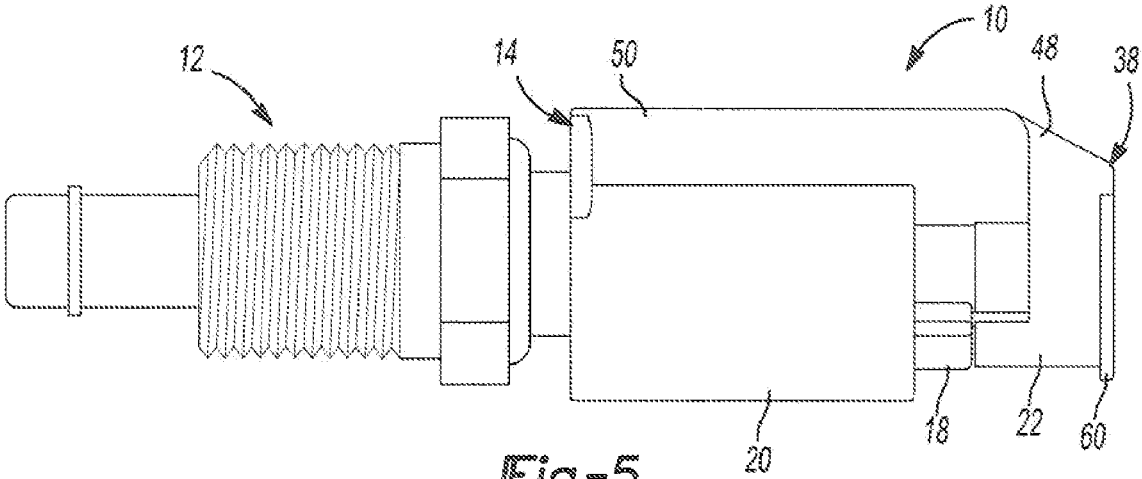
FIG. 5 is a side-perspective view of the connector assembly illustrated in FIG. 1.

Referring to FIGS. 3-5, CPA component 22 is generally a monolithic plastic structure that includes a first end 38 that is generally cylindrically oval-shaped, and a second end 40 that extends upward and outward relative to the first end 38. First end 38 includes a recess 42 that accommodates conduits 18 and allows the wires and terminals (not shown) that pass through conduits 18 to pass therethrough. As CPS component 22 is telescopically slidably movable relative to housing 20, an outer surface 44 of the conduits 18 acts as a bearing surface for the inner surface 46 of the cylindrically oval-shaped first end 38.

Second end 40 of CPA component 22 may include a pair of arms 48 that may be adapted to slide along a pair of rails 50 formed in upper surface 24 of connector housing 20. Rails 50 are formed on opposing sides of latch assembly 26. Similar to the outer surface 44 of conduits 18, rails 50 provide a bearing surface for arms 48 as CPS component 22 is slidingly actuated relative to housing 20. Between arms 48 proximate first end 38 may be provided an optional support arm 52 that may serve as a reinforcing member. Support arm 52 provides increased strength to arms 48.

Arms 48 may be connected at a distal end 54 thereof by a second or secondary latch assembly 56. Secondary latch assembly 56 is similar to primary latch assembly 26 of housing 20. A latching portion 58 of secondary latch assembly 56, however, is not actuatable like primary latch assembly 26, nor is secondary latch assembly 56 in contact with protrusion 28 formed on device 12. In contrast, secondary latch assembly 56 is provided with a protrusion (not shown) on latching portion 58 that slides over and latches onto distal end 30 of primary latch assembly 26. In this manner, lever 34 of primary latch assembly 26 is prevented from actuating, thus preventing opening or hook 32 from disengaging protrusion 28 formed on device 12. In this manner, secondary latch assembly 56 of CPS component 22 further reliably ensures that electrical connector assembly 10 remains mated with device 12.

CPA component 22 is telescopically slidably movable relative to housing 20. Accordingly, to actuate CPA component 22 to a locking position, the user simply needs to provide a force on CPA component 22 from the rear (i.e., to first end 38 of the CPA component 22) that is sufficient to force CPA component to slide relative to housing 20. Furthermore, because CPA component 22 may be forced to slide relative to housing 20 from the rear (i.e., by providing a force to first end 38 of CPA component 22), CPA component 22 and electrical connector assembly 10 may be engaged with device 12 with a single motion. That is, by sliding connector assembly 10 over device 12 and pressing on CPA component 22 simultaneously, both primary and secondary latch assemblys 26 and 56 may be actuated in a single motion.

To disengage secondary latch assembly 56 and CPA component 22, the user merely pulls on first portion 38 of CPA component 22 with a force sufficient to disengage protrusion from distal end 30 of primary latch assembly 26. To enable a user to pull on first end 38 of the CPA component 22, first end 38 is provided with a collar 60 that surrounds recess 42. After CPA component 22 has been slidably moved away from housing 20, electrical connector assembly 10 may be removed from device 12 by depressing lever 34 of latch assembly 26 to lift opening or hook off of protrusion 28 to remove housing 20 from device 12.

Because CPA component 22 is slidable or telescopically engageable with housing 20, CPA component 22 provides a secondary locking assembly for electrical connector assembly 10 that may be actuated easily during installation of electrical connector assembly 10. For example, if electrical connector assembly 10 is to be connected to a device 12 that is located on an underside of a vehicle or in a particularly tight arrangement between various components of an engine or other system, a user may simply press the rear surface (i.e., the first end 38) of CPA component 22 to actuate and engage secondary latch assembly 56.

In contrast, if the CPA component was located on an outer surface of electrical connector housing 20 that may be disposed away from the user, the user may have difficulty in reaching the CPA component, which may increase the time to install the electrical connector assembly. Because CPA component 22 is a rear activated component, however, the time required to install electrical connector assembly 10 is reduced, and the ease of installing electrical connector assembly 10 is increased.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electrical connector assembly comprising:

a housing including a primary latch assembly disposed between a pair of rails formed in said housing; and a connection position assurance component including a main body portion that defines an axis along which said main body portion is telescopically and slidably mounted to said housing, said main body portion including a pair of arms that extend radially outward from said axis and slidably engage said rails, wherein said connection position assurance components includes a secondary latch assembly that engages said primary latch assembly.

2. The electrical connector assembly of claim 1, wherein said housing includes at least one electrical conduit, and said connection position assurance component includes a first end having a recess that accommodates said electrical conduit.

3. The electrical connector assembly of claim 1, wherein said primary latch assembly includes a lever and primary latching portion, said latching portion actuated by said lever.

4. The electrical connector assembly of claim 3, wherein said first latching portion latches onto a nib formed on a device.

5. An electrical connector assembly adapted to mount to a device, the electrical connector assembly comprising:

a housing adapted to fit the device therein, said housing including at least one electrical conduit and a pair of rails formed in said housing; and a connection position assurance component including a main body portion that defines an axis along which said component is telescopically movable relative to said housing, said connection position assurance component including a first end having a recess for accommodating said electrical conduit, and a pair of arms that extend radially outward from said axis and slidably engage said rails.

6. The electrical connector assembly of claim 5, wherein said first end including said recess includes a collar at least partially surrounding said recess.

7. The electrical connector assembly of claim 5, wherein said housing includes a first or primary latch assembly engageable with a nib formed on the device, and said connection position assurance component includes a second latch assembly engageable with said first or primary latch assembly.

8. The electrical connector assembly of claim 7, wherein between said pair of arms is provided said secondary latch assembly.

9. The electrical connector assembly of claim 7, wherein said first or primary latch assembly is provided between said rails.

10. The electrical connector assembly of claim 7, wherein said first or primary latch assembly includes a latching portion engageable with said nib, and a lever for actuating said latching portion.

11. The electrical connector assembly of claim 10, wherein said secondary latch assembly prevents lever from actuating said latching portion.

12. An electrical connector assembly adapted to mate with a device, said electrical connector assembly comprising:

a housing including a primary latch assembly disposed between a pair of rails formed in said housing that engages the device; and a connection position assurance component including a main body portion that defines an axis along which said component is telescopically engageable over an outer surface of said housing, said connection position assurance component including a pair of arms that extend radially from said axis, slidably engage said rails, and support a secondary latch assembly that engages said primary latch assembly, wherein said primary latch assembly includes a latching portion actuated by a lever, and said secondary latch assembly prevents said lever from actuating said latching portion.

13. The electrical connector assembly of claim 12, wherein said primary latch assembly and said secondary latch assembly are actuatable with a single motion.

* * * * *